US008347777B2

(12) United States Patent
Donetsky

(10) Patent No.: US 8,347,777 B2
(45) Date of Patent: Jan. 8, 2013

(54) DYNAMIC FIREARM

(76) Inventor: Yurij Igorevich Donetsky, Balashikha (RU)

( * ) Notice: Subject to any disclaimer, the term of this patent is extended or adjusted under 35 U.S.C. 154(b) by 132 days.

(21) Appl. No.: 12/737,703

(22) PCT Filed: Nov. 27, 2009

(86) PCT No.: PCT/RU2009/000656

§ 371 (c)(1),
(2), (4) Date: Feb. 7, 2011

(87) PCT Pub. No.: WO2010/041985

PCT Pub. Date: Apr. 15, 2010

(65) Prior Publication Data

US 2011/0174149 A1 Jul. 21, 2011

(30) Foreign Application Priority Data

Oct. 7, 2008 (RU) ..... 2008139537

(51) Int. Cl.
*F41A 3/00* (2006.01)

(52) U.S. Cl. ..... 89/199; 89/164; 89/170

(58) Field of Classification Search ..... 89/138, 89/159, 160, 164, 168–170, 174–177, 180, 89/181, 184, 190, 199
See application file for complete search history.

(56) References Cited

U.S. PATENT DOCUMENTS

| | | | | |
|---|---|---|---|---|
| 2,594,770 | A * | 4/1952 | Hammar et al. | 89/33.05 |
| 3,110,222 | A * | 11/1963 | Harvey | 89/159 |
| 3,500,718 | A * | 3/1970 | Stoner | 89/138 |
| 3,584,532 | A * | 6/1971 | Stoner et al. | 89/47 |
| 3,656,400 | A * | 4/1972 | Stoner et al. | 89/138 |
| 4,690,032 | A * | 9/1987 | Stoner | 89/43.01 |
| 4,934,247 | A | 6/1990 | Piscetta | |
| 5,852,253 | A * | 12/1998 | Baricos et al. | 89/1.41 |
| 6,668,478 | B2 * | 12/2003 | Bergstrom | 42/1.06 |
| 6,901,689 | B1 * | 6/2005 | Bergstrom | 42/1.06 |

FOREIGN PATENT DOCUMENTS

| | | |
|---|---|---|
| DE | 4205448 | 8/1993 |
| RU | 2002195 | 10/1993 |
| RU | 5443 | 11/1997 |
| RU | 2241939 | 12/2004 |
| RU | 2241940 | 12/2004 |
| RU | 2003118761 | 3/2005 |

OTHER PUBLICATIONS

Blagonravov A.A. 'Osnovaniya proektirovaniya avtomaticheskogo oruzhiya' Izdanie Artilleriiskoi akademii RKKA, Leningrad 1934, p. 90-93.

* cited by examiner

*Primary Examiner* — Bret Hayes
*Assistant Examiner* — Joshua Freeman
(74) *Attorney, Agent, or Firm* — Aleksandr Smushkovich

(57) ABSTRACT

In weapon shot is fired during counterrecoil. The counterrecoil energy damps the recoil energy. During recoil, the breech block is unlocked, the spent cartridge case is ejected from the barrel by the residual pressure of the powder gases and is directed by a deflector into a hole in the gun carriage. When recoiling into the aftmost position, the barrel approaches the projectile and locks it by means of the breech block. Meanwhile, the next cartridge is taken from a magazine. In the event of misfire, the barrel, continuing to counterrecoil, actuates an extractor for removing the defective projectile. A recoil imitator returns the barrel to the aftmost position, where it is loaded with a projectile in a manner similar to the post-firing recoil. The technical result is ability to load the weapon automatically before firing or to reload the weapon automatically in the event of misfire.

2 Claims, 11 Drawing Sheets

DYNAMIC FIREARM

CROSS-REFERENCES TO RELATED APPLICATIONS

This application is a U.S. national phase application of a PCT application PCT/RU2009/000656 filed on 27 Nov. 2009, published as WO2010/041985, whose disclosure is incorporated herein in its entirety by reference, which PCT application claims priority of a Russian Federation patent application RU2008139537 filed on 7 Oct. 2008.

FIELD OF THE INVENTION

This invention belongs to the field of firearms. It can be used as an artillery weapon or a small arms weapon.

BACKGROUND OF THE INVENTION AND RELATED ART

As a rule, an artillery weapon has a barrel with breech block in breeching, firing mechanism and gun carriage with antirecoil mechanism. To fire a shot, the projectile is manually inserted into the barrel breeching, the breech block locks the barrel channel and shot is fired through the firing mechanism. The barrel and breech block move backwards due to recoil. The antirecoil mechanism allows dampening the recoil energy many fold, while increasing its duration approximately in the same proportion. A part of the recoil energy (approx. 5%) is absorbed, a part of it is spent for compression of the antirecoil mechanism spring (approx. 15%) that brings the barrel in the initial position. After this the breech block usually unlocks due to the counterrecoil energy and the cartridge case is ejected from the barrel by the ejecting mechanism. The automatic reload and firing systems are usually implemented in micro-caliber guns. The automation is activated by the powder gases, part of which is discharged through the barrel channel or during the barrel recoil. To enable automatic firing, the automatic guns and automatic small arms are equipped with the breech block that can move independently with the barrel. During firing, the breech block is unlocked by the recoil energy or the energy of the powder gases discharged from the front part of the barrel, separates from the barrel, and, while moving backwards, ejects the cartridge case from barrel and compresses the back-moving spring. Once the shot has been fired, the breech block is returned to the barrel by the back-moving spring, and while moving takes the new projectile (or cartridge) and inserts it into the barrel, then locking it for the new shot. The barrel itself remains stationary relatively to the gun. The firing and reload automation is quite complex and irrational. In the beginning, part of the firing energy cocks springs of the breech block and the firing mechanism and those afterwards perform loading and firing using the springs. Heavy working conditions of the automation (high temperatures, presence of solid combustion products, short period of time to convert part of the firing energy into the automation action) demand high reliability and manufacturing quality of the gun mechanisms.

Nikonov AN-94—"Abakan" is a known assault rifle. It is designed as a system equipped with gun carriage. While firing in bursts or in two shots, the first shot is fired with the barrel being stationary. Once the shot is fired, the barrel, along with the breech block and the barrel extension, due to recoil moves back on the guiding gunstock, performing reloading and firing of the second cartridge while moving due to action of powder gases. Such system allows firing two shots before recoil affects shoulder of the rifleman, increasing accuracy and efficacy of shooting. In the same time the automation design is more complicated compared to the stationary barrel weapon (e.g. the AKM assault rifle), reducing its reliability, increasing its manufacturing laboriousness and making the operation more complicated. Practically, the gun automation is based on the same principles that are implemented in the stationary barrel weapon (such as separation of the breech block from the barrel while reloading, recoil energy accumulation using compression of back-moving spring of breech block and firing mechanism spring). Benefits of the direct action of moving barrel on the breech block and firing mechanisms (utilization of the recoil kinetic energy) are not used.

Loading and firing automation of the weapon in the suggested invention utilizes kinetic energy of barrel movement during its recoil and counterrecoil. The breech block does not move away from the barrel and for that reason the suggested weapon design is the closest one to that of non-automatic artillery weapon taken as prototype (www.weltkrieg.ru/artillery/ustroistvo), that includes barrel with inseparable breech block in breeching, firing mechanism and gun carriage with antirecoil mechanism. The recoiling parts of the weapon have a significant weight—its moving and hitting in the front and rear positions cause significant oscillation of the weapon and considerable scattering of projectiles. A time period is necessary for damping of the weapon oscillation. Implementation of reload automation does not improve the rate of fire and is considered impractical. In the event of misfire, ejection of the misfired projectile and reloading are done manually.

BRIEF DESCRIPTION OF THE INVENTION

The present invention provides the following technological results:

- improved efficacy of recoil energy absorption and damping of the weapon oscillation after firing;
- simplified design and weight reduction;
- improved reliability and pattern of automatic shooting;
- automatic loading prior to firing or reloading in the event of misfire;
- possibility of the firing rate adjustment in a wide range.

The aforesaid technological results are achieved by the following measures: the firing mechanism is equipped with the check that can hold the barrel with the breech block in the extreme recoil position and the firing mechanism is capable of firing during the barrel counterrecoil, utilizing its kinetic energy. The breech block has flanges enabling its locking and unlocking during the barrel recoil or counterrecoil; the gun carriage has guides for the breech block flanges that have areas allowing the barrel to move with the breech block locked during counterrecoil, the breech block also can be unlocked in the initial phase of recoil after firing, move with the breech block unlocked during recoil and to lock in the extreme recoil position. The guides for the breech block flanges have areas enabling, in the event of misfire, to resume the counterrecoil movement of barrel with the breech block unlocking and recoiling with the breech block unlocked from the extreme counterrecoil position. There is the extractor capable of stopping the projectile and ejecting it from the barrel during counterrecoil. There is the recoil imitator equipped with the check that releases the recoil imitator spring when the barrel is in the extreme counterrecoil position, that can move the barrel the extreme counterrecoil position to the extreme recoil position. There is projectile holder that holds it so that during the barrel movement to the extreme recoil position, the projectile, while remaining stationary, can take place in the barrel chamber. There is device feeding the projectile holder with projectiles that utilizes the counter-recoil energy. There is a guiding deflector that can change the movement direction of the spent cartridge case that left the barrel and to move aside by the action of the spent cartridge case or the recoiling barrel, allowing the barrel and the breech block to recoil.

PREFERRED EMBODIMENTS OF THE PRESENT INVENTION

Figure 1A:
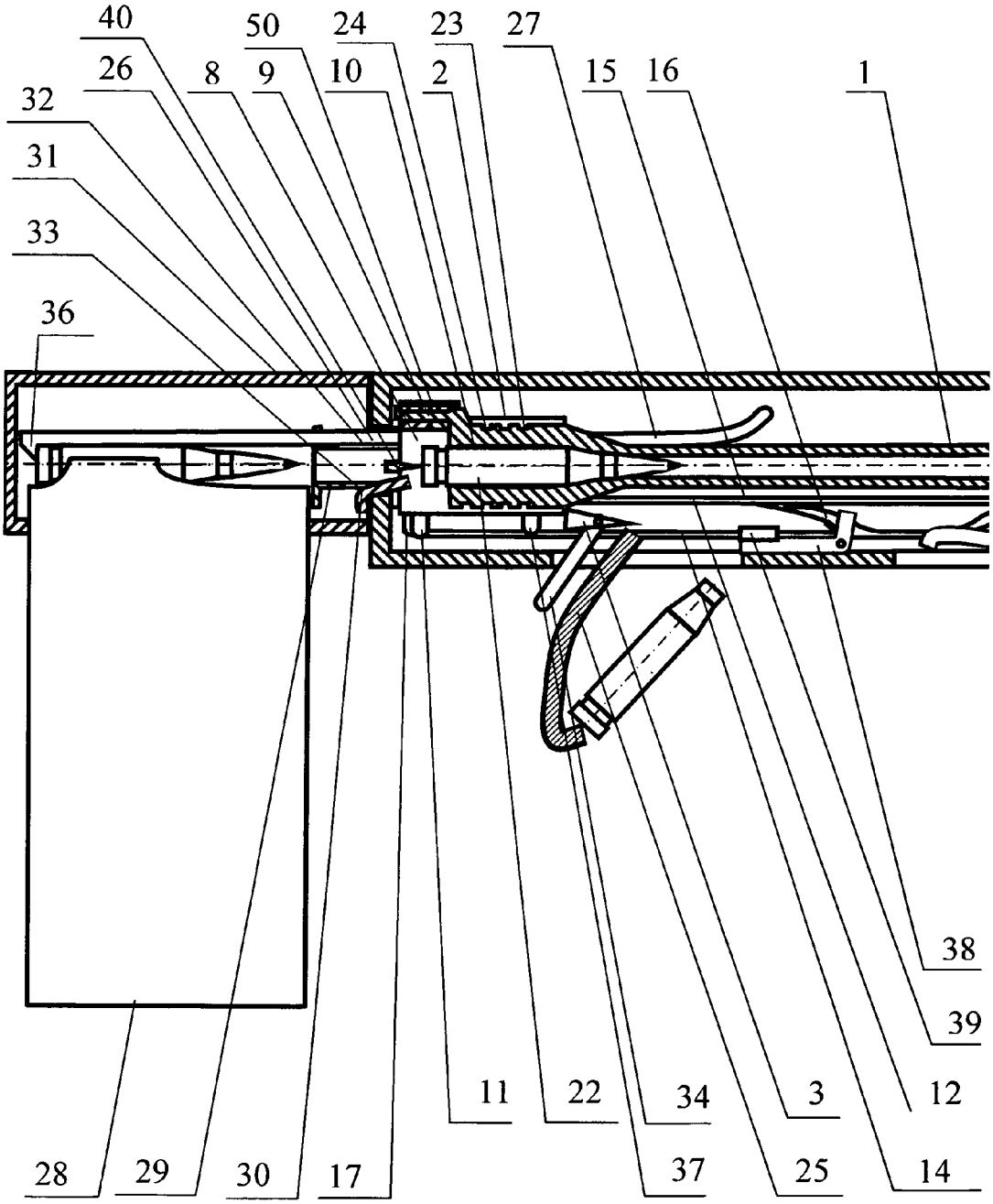
FIG. 1*a* depicts rear part fragment of a dynamic firearm with its barrel fixed in the extreme recoil position.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

A preferred embodiment of the firearm comprises:
Barrel (1) (illustrated on FIGS. 1*a* and 1*b*) with breech block (2) in the gun carriage, firing mechanism, with check (3) being a part of it, with lever (34), gun carriage (13) with antirecoil mechanism (4).

Dynamic weapon works as follows. Barrel (1) (FIG. 1*a*) with breech block (2) is held in the extreme recoil position with check (3) preventing it from counterrecoil by the action of antirecoil mechanism (4) (FIG. 1*b*), placed around the barrel (1) (FIG. 1*a*), where piston (5) (FIG. 1*b*) is installed. Piston (5), through brake fluid (6) is activated by pressure exerted by the gas situated in chamber (7) (brake fluid is not necessary for implementation in small arms—and then the antirecoil mechanism will act as recuperator mechanism; small weight of the details being moved makes it possible to reach high barrel speed during counterrecoil, consequently improving recoil damping). Pressure in the chamber (7) is set so that at the moment of firing the barrel was accelerated to the maximum speed, not causing the weapon oscillation and not upsetting the sight.

Figure 1B:
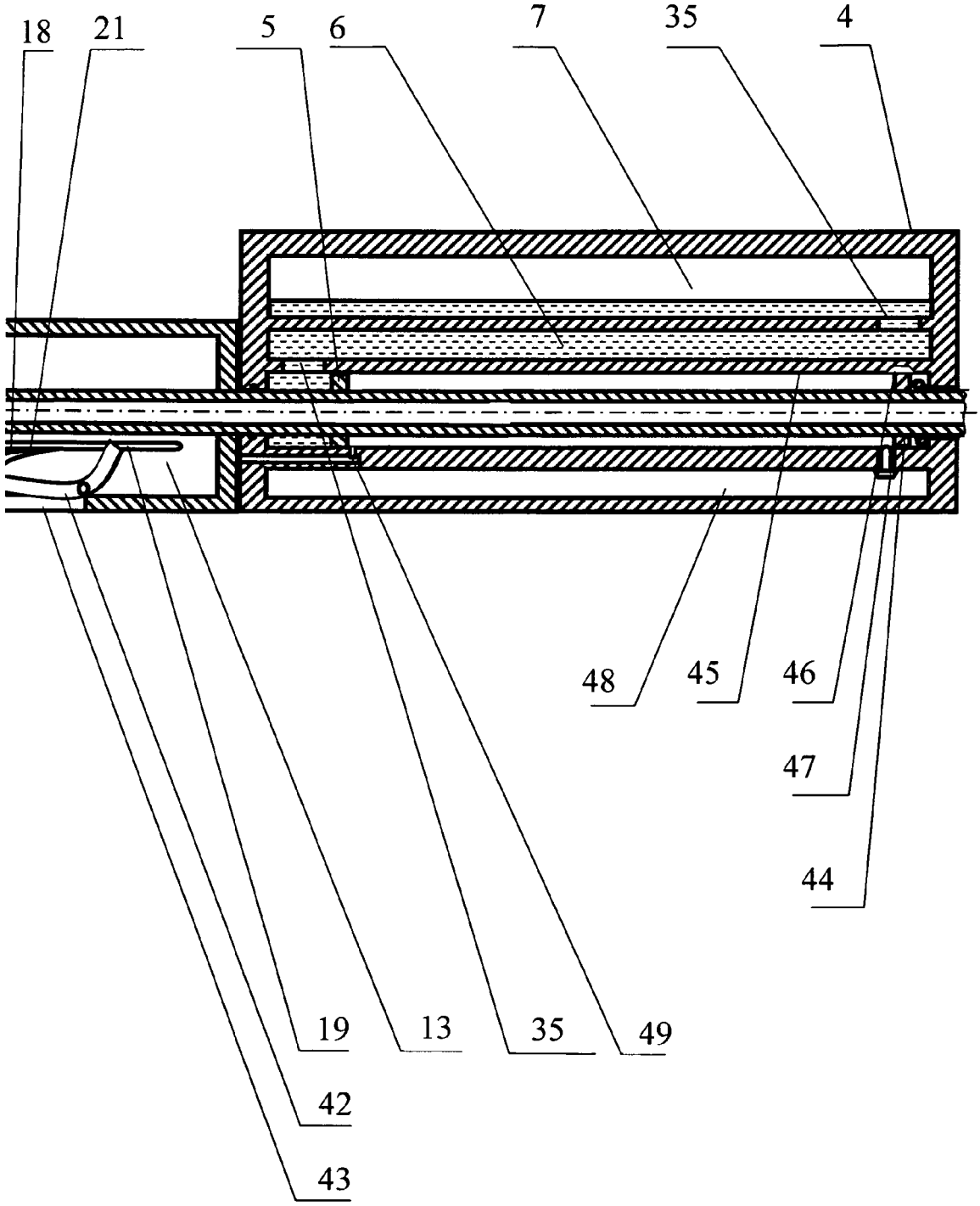
FIG. 1*b* depicts fore-part fragment of a dynamic firearm with its barrel fixed in the extreme recoil position.
Figure 5:
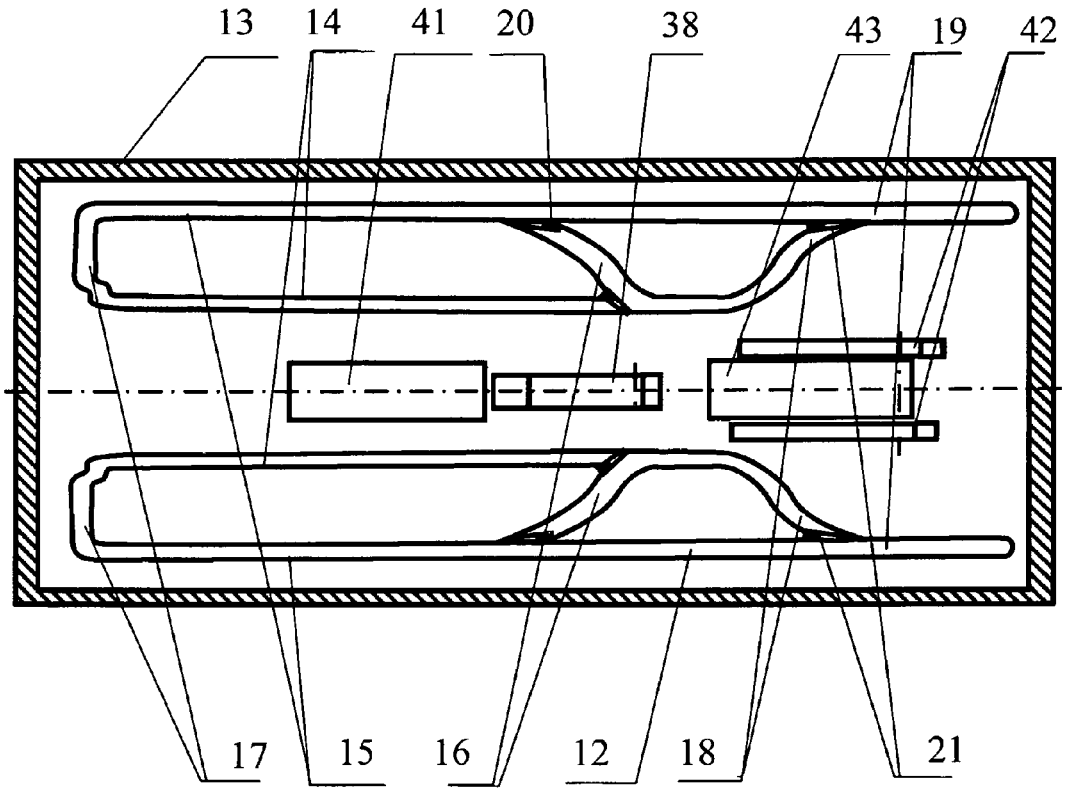
FIG. 5 depicts fragment of a dynamic firearm with guiding for the breech block flanges, top view.
Figure 6:
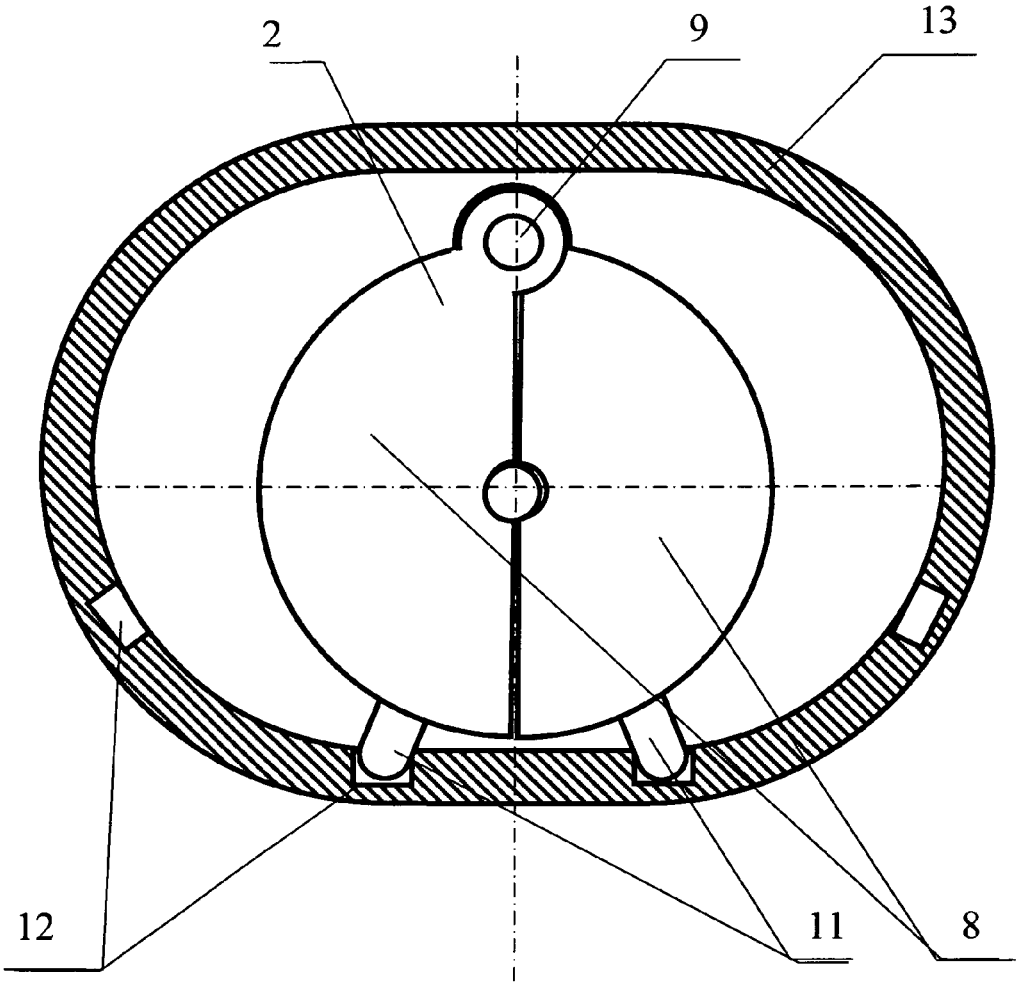
FIG. 6 depicts crossection of a dynamic firearm gun carriage with its breech block locked, view from the breeching side.

The breech block is made as two halves of a cylindrical cup (8) (FIG. 1*a*, FIG. 6), placed on shaft (9), installed at the end wall above barrel chamber (10) of barrel (1)(FIG. 1*a*). Flanges (11)(FIG. 1*a*, FIG. 6) of the breech block are situated in guiding (12) (FIG. 5) on the inside of the gun carriage (13), made in the shape of box. The guides have areas enabling barrel counterrecoil with the breech block (14) being locked, barrel recoil with the breech block (15) being unlocked, breech block unlocking during recoil after firing (16), breech block locking when the barrel is in the extreme recoil position (17), breech block unlocking during counterrecoil after misfire (18) (FIG. 1*b*), barrel recoil with breech block being unlocked after misfire (19). At the point of the guides branching (20) (FIG. 5) there are installed spring-loaded flaps (21) that change recoil movement direction after passing the points of branching during counterrecoil. When the flanges are in the guides in the area of locked breech block (14), the rear part of the breech block cup tightly holds the projectile (22) (FIG. 1*a*), placed in the chamber (10). The front part of the breech block cup tightly holds the chamber (10). On the chamber there are profiled slots (23) with the corresponding flanges on the breech block (24). Interlocking with the flanges provides reliable fixture of locked breech block on the barrel during firing. Flanges (11) of the breech block (2)(FIG. 6) are situated at the end of the guides area of the breech block locking in the extreme recoil position (17)(FIG. 5). The guiding deflector (25) (FIG. 1*a*) is held by the barrel in the lower position.

The projectile feeding device is a bar (26) that can move on guiding (27). One end of the bar is interlocked with the breech block (2). The other end of the bar is interlocked with the projectile in the magazine (28). The projectile holder includes the holder cartridge (29) with flanged edges that can accommodate projectile and rest (30) securing the projectile in the cartridge from moving towards the magazine. In the extreme recoil position the rest (30) of the projectile holder prevents the breech block from complete locking. For this reason on the guides, at the end of the area of the breach locking, there is a stepped bend. The holder cartridge is placed in the partition between the gun carriage (13) (FIG. 1*b*) and the magazine box (31) (FIG. 1*a*), and it can move towards the gun carriage from the magazine and back. The cartridge has a cutout for the rest (33) and a cutout for the bar (32).

Figure 2A:
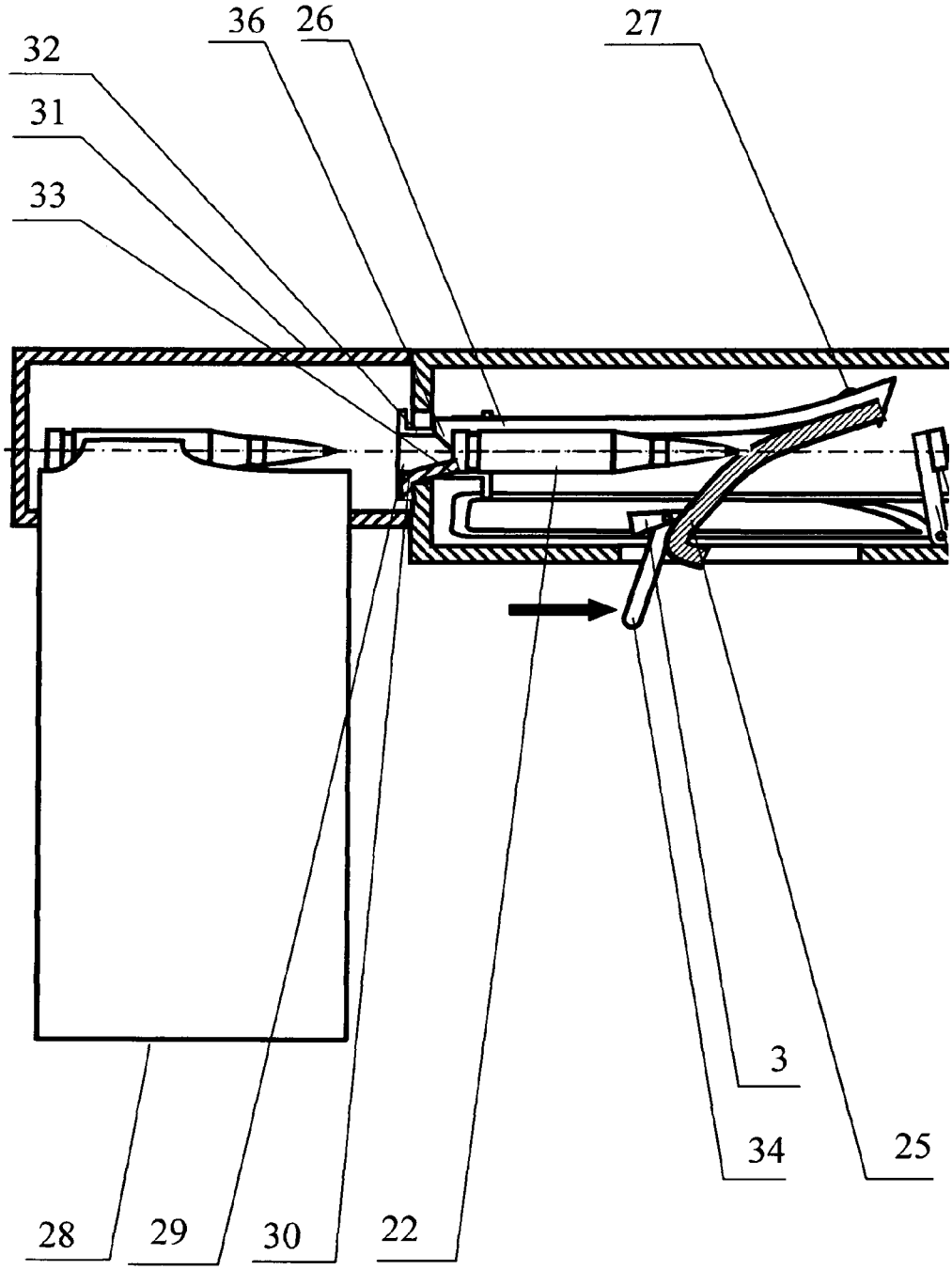
FIG. 2*a* depicts rear part fragment of a dynamic firearm with its barrel moving into the counterrecoil position at the moment of firing mechanism actuation.
Figure 2B:
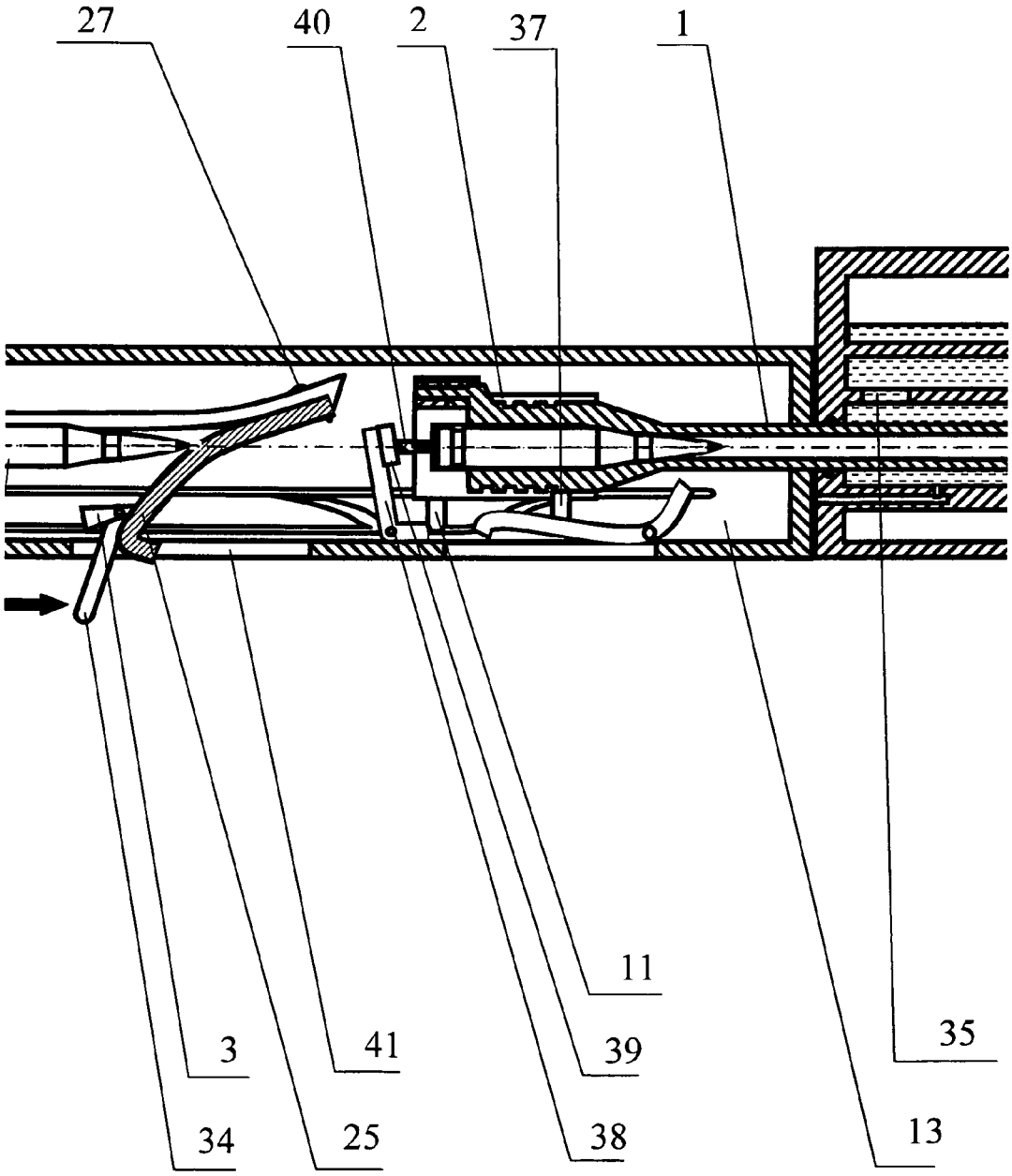
FIG. 2*b* depicts middle part fragment of a dynamic firearm with its barrel moving into the counterrecoil position at the moment of firing mechanism actuation.
Figure 2C:
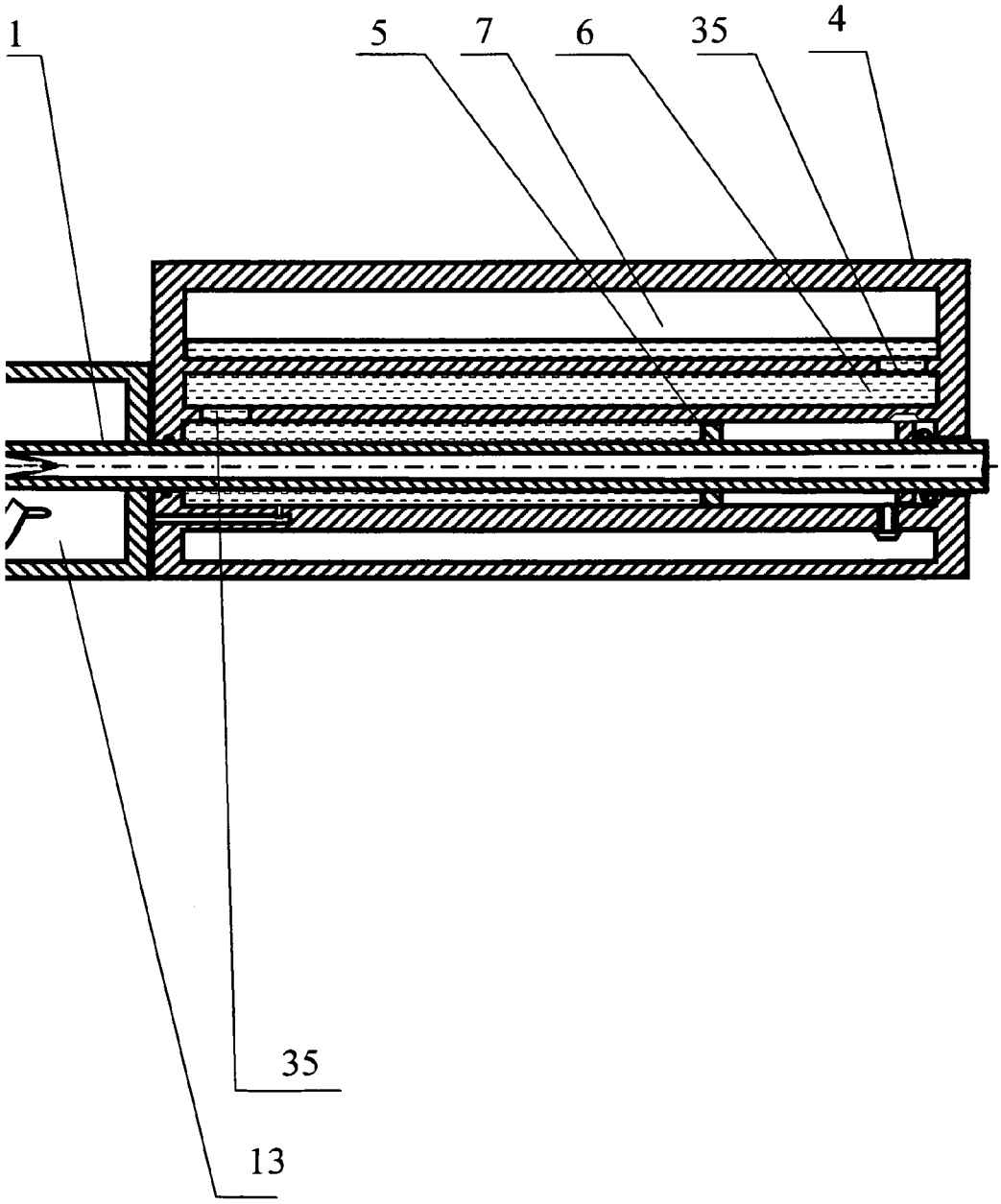
FIG. 2*c* depicts fore-part fragment of a dynamic firearm with its barrel moving into the counterrecoil position at the moment of firing mechanism actuation.

Check (3) with lever (34) is a part of the firing mechanism, the rest of which is not shown on the dynamic firearm fragments. The arrow (FIG. 2*a*) shows direction of the force exerted on lever (34) by the firing mechanism. The lever turns the check (3), allowing the barrel (1) (FIG. 2*b*) with projectile (22) (FIG. 2*a*), held in the chamber with breech block (2) (FIG. 2*b*) to start to counterrecoil with acceleration, moved by the antirecoil mechanism (4) (FIG. 2*c*). During this the transfer ports (35) of antirecoil mechanism (4) fully open. Having passed the stepped bend at the end of the breech block shutting area of the guides (17)(FIG. 5, FIG. 6), flanges (11) (FIG. 2*b*) fully lock the breech block (2). The bar (26) (FIG. 2*c*) of the projectile feeding device, moving along with the breech block, with its flange (36) moves the projectile from magazine (28) into the projectile holder cartridge (29), that in its turn moves to the extreme front position. Moving along the cartridge, the projectile presses out the rest (30) downwards. After the bar (26) of the projectile feeding device, with its flange (36), passing through the cutout (32) in cartridge (29), moved projectile from magazine in the front part of the holder cartridge, to the position when the rest (30) raises from the back side of the cartridge bottom in the cutout (33), the front part of the bar (26), moving along the guide (27) will slightly move up and disengage with the breech block (2) (FIG. 2*b*). After the barrel breeching (1) moved forward in front of the deflector (25), the deflector will raise and take the working position inside of the gun carriage (13). During the subsequent accelerated movement of the barrel (1) the breech block (2), with its flange (37) affects one shoulder of the firing mechanism (38). As a result, the other shoulder, with its toe (39) hits firing pin (40). A shot is fired. Part of the recoil energy is spent for damping of the counterrecoil energy. The rest of the recoil energy, similarly to the analogues, described above, is absorbed by brake fluid (6) (FIG. 2*c*) of the antirecoil mechanism (4) and is spent for cocking of its back-moving pneumatic spring (to raise the pressure in chamber (7)).

During recoil of the barrel (1) (FIG. 1*a*) flanges (11) of breech block (2) with the spring-loaded flaps (21) (FIG. 5) change the movement direction from the area of counterrecoil barrel movement with the breech block (14) locked, through the area of the breech block unlocking during recoil after firing (16) to the area of recoil barrel movement with unlocked breech block (15). During this the breech block (2) (FIG. 1*a*) is unlocked and the spent cartridge case is ejected by the residual powder gas pressure. The deflector (25) changes the direction of the cartridge case movement and, along with the deflector moves below the gun carriage (13) (FIG. 1*b*) through opening (41). During the subsequent recoil of the barrel (1) (FIG. 1*a*) the breech block (2) moves the bar (26) of the projectile feeding device along the guiding (27). Moving along the guiding (27), the front end of the bar (26) lowers and engages with breech block. Continuing to recoil, the barrel (1) with unlocked breech block (2) approaches the projectile held in the projectile holder. The projectile holder cartridge (29) is moved by the breech block (2) into the extreme rear position. The projectile held by the rest (30) of the projectile holder, takes place in the chamber (10) of the barrel (1). In the extreme recoil position the flanges (11)(FIG. 1*a*, FIG. 5) move to the area of the guides of the breech block locking in the extreme recoil position (17). By the action of the breech block spring (50) (FIG. 1*a*) the breech block (2) locks, not reaching the end by the distance equal to the thickness of the rest (30) of the projectile holder. The flange (36) placed on the rear end of bar (26) stops behind the bottom of the projectile cartridge case of the magazine (28). In the one shot firing mode the latch 3 turns into the position of the barrel (1) (FIG. 1*a*) holding with the breech block (2) being in the extreme recoil position. All the weapon mechanisms are reset to the initial position of readiness to fire. In the automatic firing mode the firing mechanism prevents the latch 3 from holding the barrel (1) and the breech block (2). The counterrecoil movement is started by the action of the antirecoil mechanism (4), and the firing cycle repeats.

The firing rate can be adjusted in a wide range by changing pressure in the chamber (7) (FIG. 1*b*) of the antirecoil mechanism (4) or changing section of the transfer parts (35). One of the design advantages is easier directing and aiming of the weapon as the center of gravity in the extreme recoil position is situated closer to the rotation axes of the guiding devices, compared to the extreme counterrecoil position, creating less moment of resistance to the guidance mechanisms. The barrel oscillations are dampened more effectively as there is a pause between recoil and counterrecoil and the barrel does not hit the support when in the front position.

Figure 3:
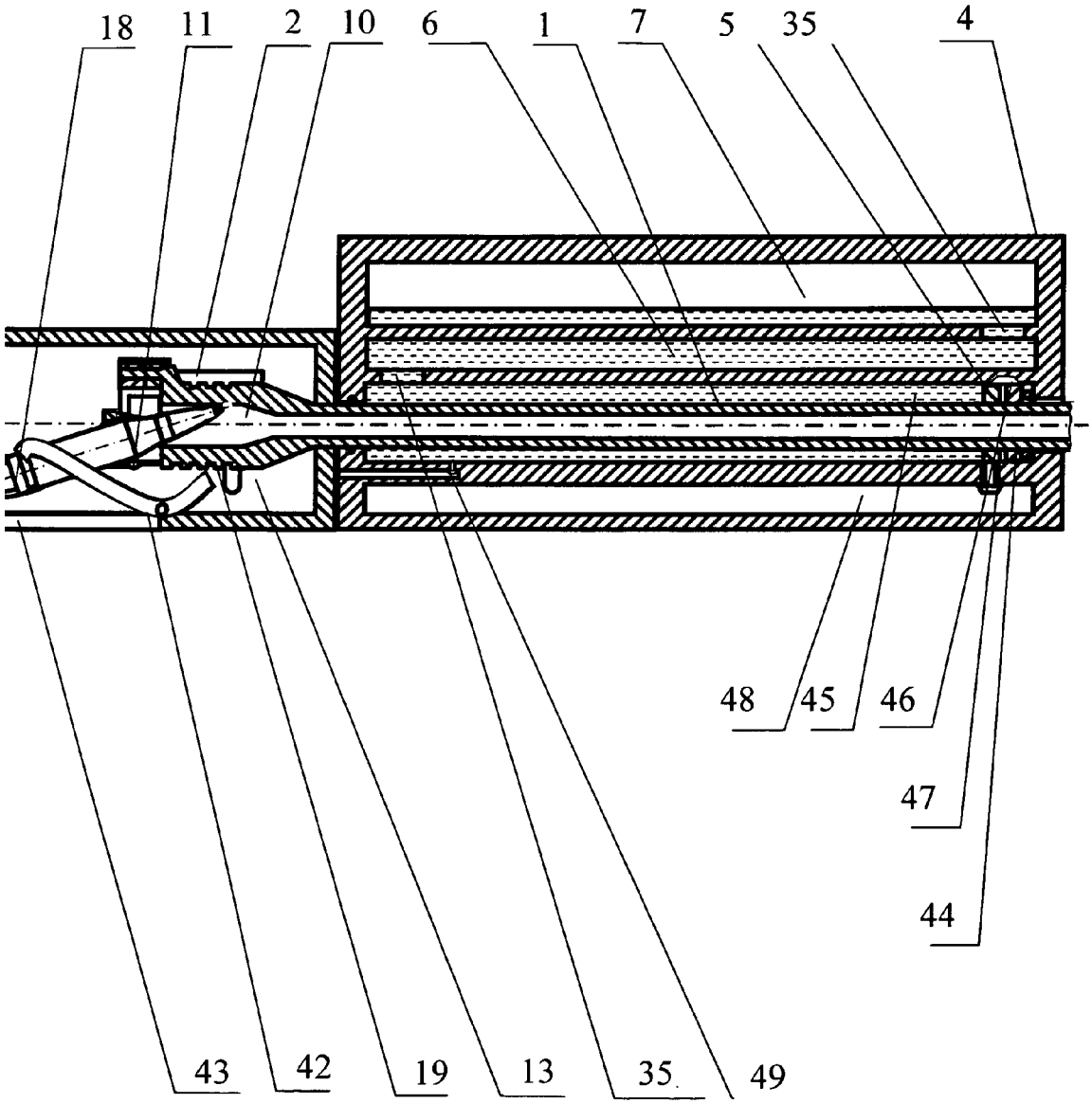
FIG. 3 depicts fragment of a dynamic firearm with its barrel moving into the counterrecoil position after misfire at the moment of extractor actuation.
Figure 4A:
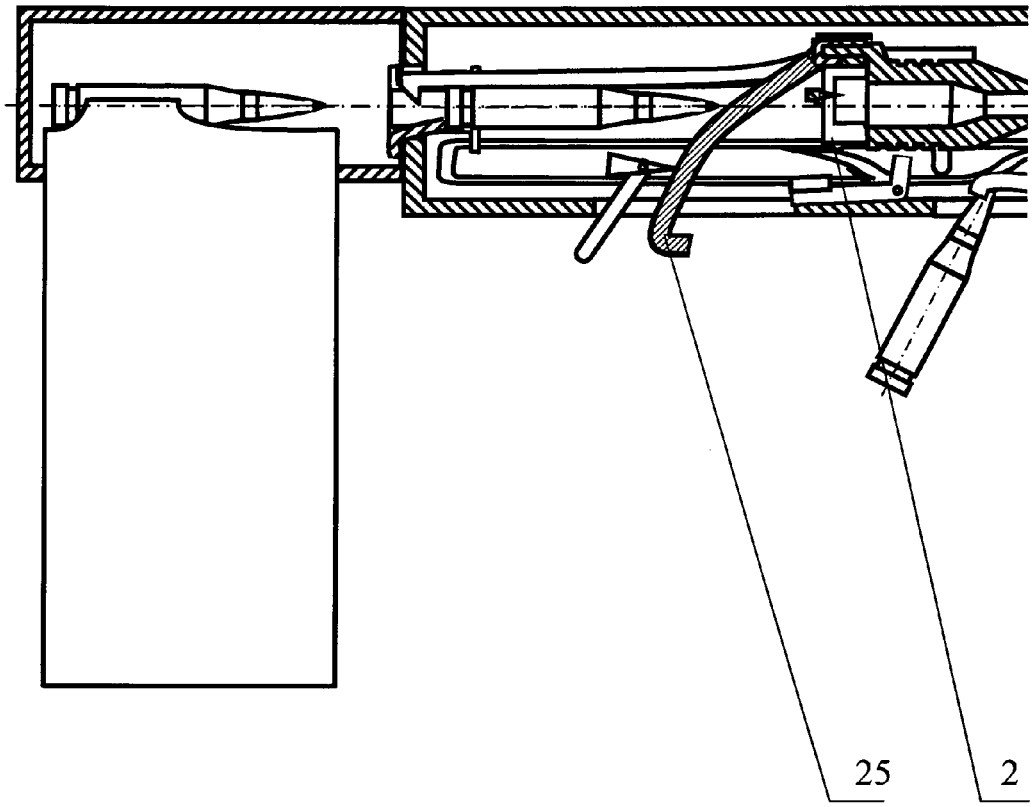
FIG. 4*a* depicts rear part fragment of a dynamic firearm with its barrel moving in the recoil position after misfire and actuation of the recoil imitator.
Figure 4B:
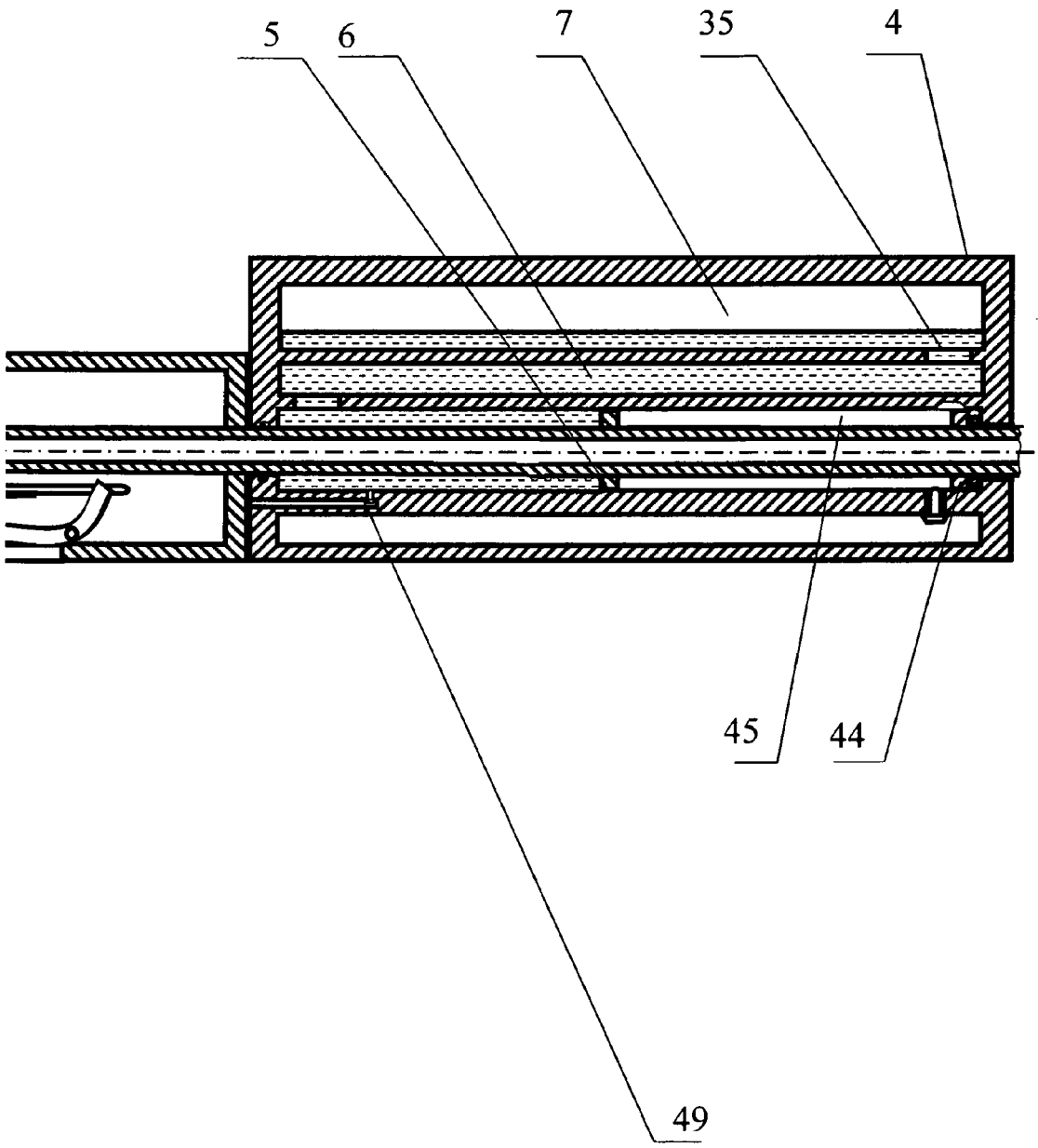
FIG. 4*b* depicts fore-part fragment of a dynamic firearm with its barrel moving in the recoil position after misfire and actuation of the recoil imitator.
Figure 7:
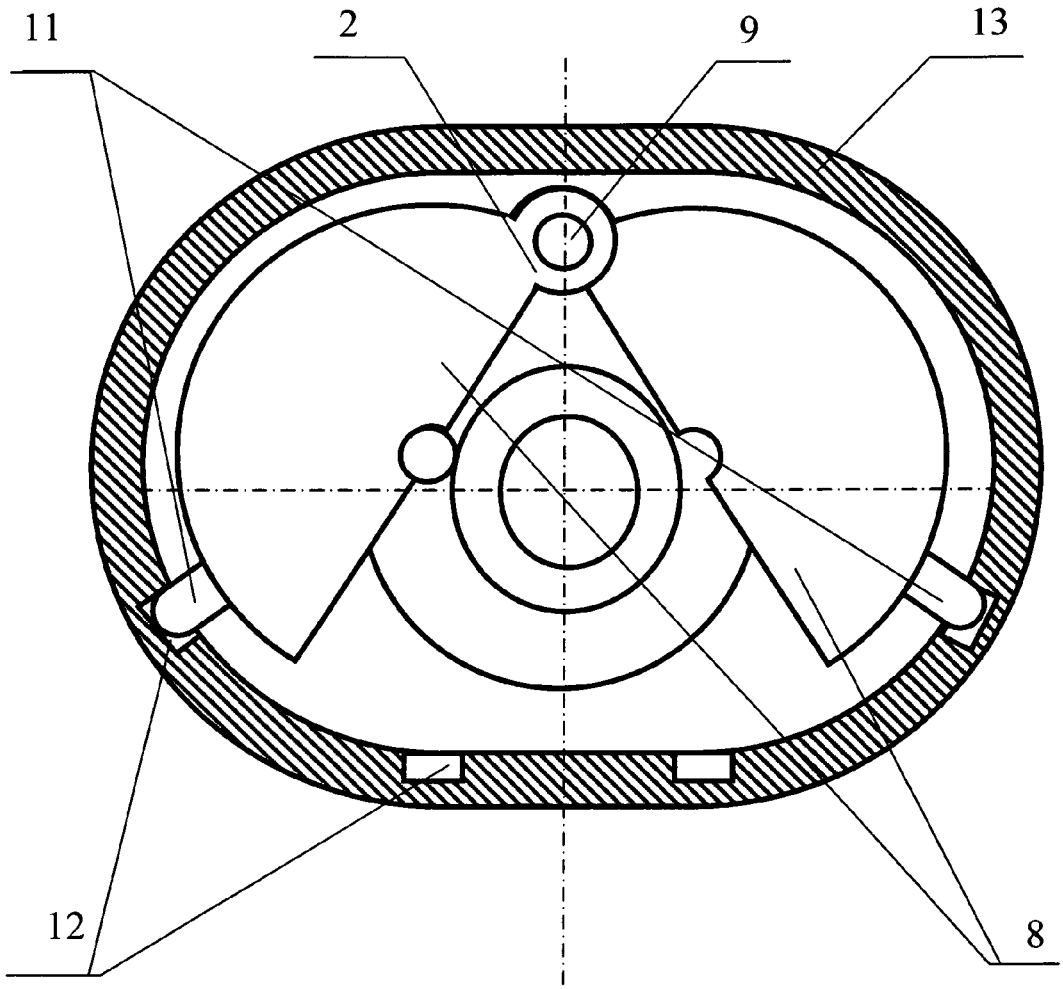
FIG. 7 depicts crossection of a dynamic firearm gun carriage with its breech block open, view from the breeching side.

In the event of misfire the barrel (1) (FIG. 2*b*) keeps to counterrecoil from the position where it was at the moment of firing. The flanges (11) move to the areas of the guides of breech block unlocking during counterrecoil after misfire (18) (FIG. 5). By the action of the flanges (11) (FIG. 3, FIG. 7) the breech block (2) unlocks and actuates the extractor (42)(FIG. 3), turning one of its shoulders along the way of counterrecoil. During this the second shoulder of the extractor raises and engages with the flange of the projectile cartridge case. The projectile is held in place with the extractor and the barrel (1) with the breech block (2) continues to counterrecoil until the projectile leaves the chamber (10). After this the breech block releases the front shoulder of the extractor with the rear shoulder of the extractor lowering and the projectile falls through the gun carriage opening (43). After the breech block flanges (11) move to the area of the barrel recoil with unlocked breech block after misfire (19) (FIG. 5), the barrel piston (5) (FIG. 3) presses the bypass valve (44), that closes the air outlet from the piston chamber (45) into the atmosphere through the opening (46). Simultaneously the piston opens the valve (47), which acts as the latch for the pneumatic spring of the recoil imitator and allows the gas of the high pressure chamber of the recoil imitator (48) to enter the piston chamber (45). As the gas pressure in the piston chamber (45) exceeds the gas pressure in the chamber (7) of the antirecoil mechanism (4) (FIG. 4*b*), the barrel starts to recoil. After the breech block pushes the deflector (25) into the lower position during the recoil, the weapon is loaded and fixed as during recoil after firing (FIG. 1*a*), as described above. When the barrel piston (5) (FIG. 4*b*) reaches the extreme recoil position, it opens the release valve (49). The piston chamber pressure (45) balances out with the atmospheric pressure and the bypass valve (44) opens. All the weapon mechanisms are reset to the initial position of readiness to fire.

In the automatic firing mode the firing mechanism prevents the latch (3) (FIG. 1*a*) from holding the barrel (1) and the breech block (2). The counterrecoil movement is started by the action of the antirecoil mechanism (4), and the firing cycle repeats. The gas in the high pressure chamber of the recoil imitator (48) (FIG. 1*b*) can be replenished with the powder gases produced during firing. In such case it is reasonable to make the high pressure chamber of the recoil imitator in the shape of a jacket placed around the barrel, with the valve that is activated by pressing on the bypass valve and installed in the front wall of the jacket. The initial loading is done with the use of the recoil imitator. The weapon is ready to fire immediately after installation of the ammunition magazine (28) (FIG. 1*a*), simply by pressing lever of the trigger device (trigger—for small arms weapon).

Thus the suggested dynamic weapon provides firing with the minimal recoil having simple and reliable automatic reload and firing system that is capable to fire continuously and without any manipulations after misfire or installation of the magazine or the ammunition feed strip. It allows easier targeting and aiming, and improved damping of the barrel oscillation during recoil and counterrecoil movements.

The invention claimed is:

1. A firearm, comprising barrel and breech block, firing mechanism, gun carriage with antirecoil mechanism, guides for flanges of said breech block, wherein said firearm includes:

a firing mechanism latch that can keep the barrel and the breech block in the extreme recoil position, the said mechanism allows firing during the barrel counterrecoil movement, utilizing its kinetic energy;

flanges that allow locking and unlocking of said breech block during the said barrel recoil and counterrecoil;

said gun carriage is equipped with the guides for the flanges of said breech block, that have special areas allowing said barrel to move with locked said breech block during counterrecoil, unlocking said breech block after firing in the beginning of recoil, moving with unlocked said breech block during recoil, locking said breech block in the moment of the extreme recoil;

areas allowing said barrel to resume counterrecoil movement after misfire with unlocking of said breech block and to recoil with unlocked said breech block from the extreme counterrecoil position;

extractor that can stop the projectile and eject it from said barrel that continues counterrecoil movement;

recoil imitator that includes a latch releasing a recoil imitator spring in the extreme counterrecoil position of said barrel, that can move said barrel from the extreme counterrecoil position into the extreme recoil position.

2. The firearm, according to claim 1, comprising said barrel and said breech block, said firing mechanism, said gun carriage with antirecoil mechanism, said guides for said flanges of said breech block, wherein said firearm is equipped with a projectile feeding device, including:

a projectile holder that holds projectiles in such a way that during said barrel recoil to the extreme recoil position, the projectile remains stationary while taking place in said barrel chamber;

a projectile feeding device to the projectile holder that utilizes the counterrecoil energy;

a guiding deflector that can change the movement direction of the spent cartridge case that left said barrel and to move aside allowing said barrel and said breech block to recoil.

* * * * *